US007948351B2

(12) United States Patent
Yu

(10) Patent No.: US 7,948,351 B2
(45) Date of Patent: May 24, 2011

(54) CIRCUIT PROTECTION DEVICE HAVING WARNING FUNCTION

(76) Inventor: Tsung Mou Yu, Taipei (TW)

( * ) Notice: Subject to any disclaimer, the term of this patent is extended or adjusted under 35 U.S.C. 154(b) by 204 days.

(21) Appl. No.: 12/421,631

(22) Filed: Apr. 9, 2009

(65) Prior Publication Data

US 2010/0259410 A1 Oct. 14, 2010

(51) Int. Cl.

| | |
|---|---|
| ***H01H 71/16*** | (2006.01) |
| ***H01H 37/02*** | (2006.01) |
| ***H01H 37/32*** | (2006.01) |
| ***H01H 37/46*** | (2006.01) |

(52) U.S. Cl. ..... 337/79; 337/14; 337/16; 337/27; 337/36; 337/53; 337/66; 337/85; 337/89

(58) Field of Classification Search ..... 337/14, 337/16, 27, 36, 53, 66, 85, 89, 79; 340/815.45
See application file for complete search history.

(56) References Cited

U.S. PATENT DOCUMENTS

| | | | | |
|---|---|---|---|---|
| 3,311,725 | A * | 3/1967 | Butler et al. | 337/343 |
| 4,342,979 | A * | 8/1982 | Phillips | 337/41 |
| 4,833,439 | A * | 5/1989 | Bowden et al. | 337/68 |
| 5,089,799 | A * | 2/1992 | Sorenson | 337/68 |
| 5,513,063 | A * | 4/1996 | Wu | 361/105 |
| 5,541,569 | A * | 7/1996 | Jang | 337/68 |
| 5,760,672 | A * | 6/1998 | Wang | 337/79 |
| 5,889,457 | A * | 3/1999 | Hsu et al. | 337/59 |
| 5,918,361 | A * | 7/1999 | Moalem et al. | 29/622 |
| 6,252,490 | B1 * | 6/2001 | Lin | 337/79 |
| 6,275,134 | B1 * | 8/2001 | Chen | 337/37 |
| 6,377,158 | B1 * | 4/2002 | Yu | 337/37 |
| 6,445,273 | B1 * | 9/2002 | Yu | 337/37 |
| 6,563,414 | B2 * | 5/2003 | Yu | 337/66 |
| 6,570,480 | B1 * | 5/2003 | Huang | 337/79 |
| 7,336,149 | B2 * | 2/2008 | Ullermann | 337/66 |
| 2006/0186984 | A1 * | 8/2006 | Ullermann | 337/14 |

* cited by examiner

*Primary Examiner* — Anatoly Vortman

(57) ABSTRACT

A circuit protection device having a warning function includes a casing with a button, a first terminal and a second terminal connected thereto. A resilient bi-metallic plate is connected between the two terminals and bends to be separated from the second terminal when the circuit protection device is overheated. A warning light is located within the button and connected to the first terminal. When a main circuit is connected, no current flows through the warning light which is not activated. When the main circuit is overheated, the bi-metallic plate bends to cut off the main circuit and a connection member on the warning light is in contact with the second terminal to form a circuit to light up the warning light.

14 Claims, 14 Drawing Sheets

CIRCUIT PROTECTION DEVICE HAVING WARNING FUNCTION

BACKGROUND OF THE INVENTION

1. Field of the Invention

The present invention relates generally to a circuit protection device having a warning function, and in particular to a circuit protection device having a warning function to inform the users about the circuit being cut off due to overload or overheat.

2. The Prior Arts

A conventional circuit protection device generally includes a bimetallic plate which bends toward another direction during overflow of the current so as to separate two contact points to cut off the circuit to protect the electric appliance from being burned.

The first shortcoming of the conventional circuit protection device is that it lacks a warning function to inform the users that the circuit is in an abnormal state. The conventional circuit protection device can only cut off the circuit but cannot inform the users that the appliance is not functioning. The second shortcoming of the conventional circuit protection device is that if there are multiple circuits involved and only one of them is cut off, the users have to spend significant time to figure out which circuit is cut off.

The present invention is to provide a circuit protection device having a warning function to inform users of a circuit being cut off due to overload or overheat. The waning device includes a warning light which lights up when the circuit is cut off so that the users can easily tell which appliance or circuit does not function properly.

SUMMARY OF THE INVENTION

A primary objective of the present invention is to provide a circuit protection device having a warning function which can inform the users by a light signal about the circuit being cut off so that the users can easily repair or replace the circuits or appliances.

The present invention provides a circuit protection device which comprises a casing and a button is connected to the casing. A first terminal and a second terminal are connected to the casing and connected with a main circuit. A resilient bi-metallic plate is bent from one side to the other side when it is overheated. A warning light is located within the button and has a first leg and a second leg. A resistor and a resilient member are connected to the first leg, and a connection member is connected to the second leg. The resilient member is connected to the first terminal and provides an upward force to the button and the warning light. When a main circuit is in a connected state, the circuit for the warning light is not connected so that the warning light is not activated. When the circuit is overheated or overloaded, the bi-metallic plate bends to cut off the main circuit, and current flows through the circuit for the warning light so that the warning light lights up.

Another objective of the present invention is to provide a warning device which is a warning light whose circuit is not connected when the main circuit of the appliance is in "ON" status, and when the main circuit for the appliance is cut off, the circuit of the warning light is connected so that the warning light lights up.

Still another objective of the present invention is to provide a warning light which lights up to inform the users which main circuit is cut off so that the users can quickly remove the problems.

Yet another objective of the present invention is to provide a circuit protection device having a warning function which can be used for multiple circuits and the warning light lights up to inform the users which circuit is cut off. The users do not need to check the circuits one by one so that time is saved and management of the multiple circuits is easy.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
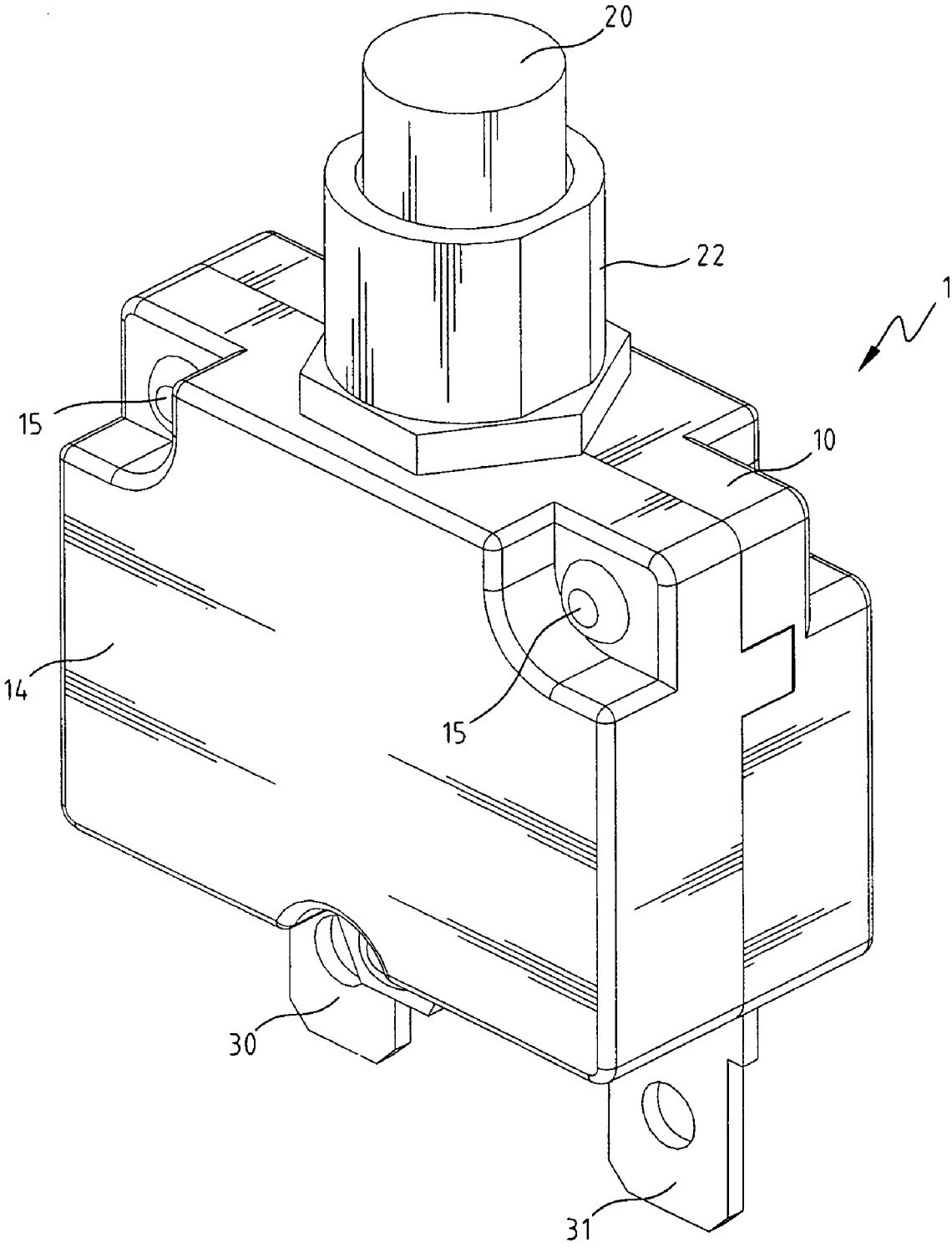
FIG. 1 is a perspective view showing a circuit protection device having a warning function in accordance with an embodiment of the present invention.
Figure 2:
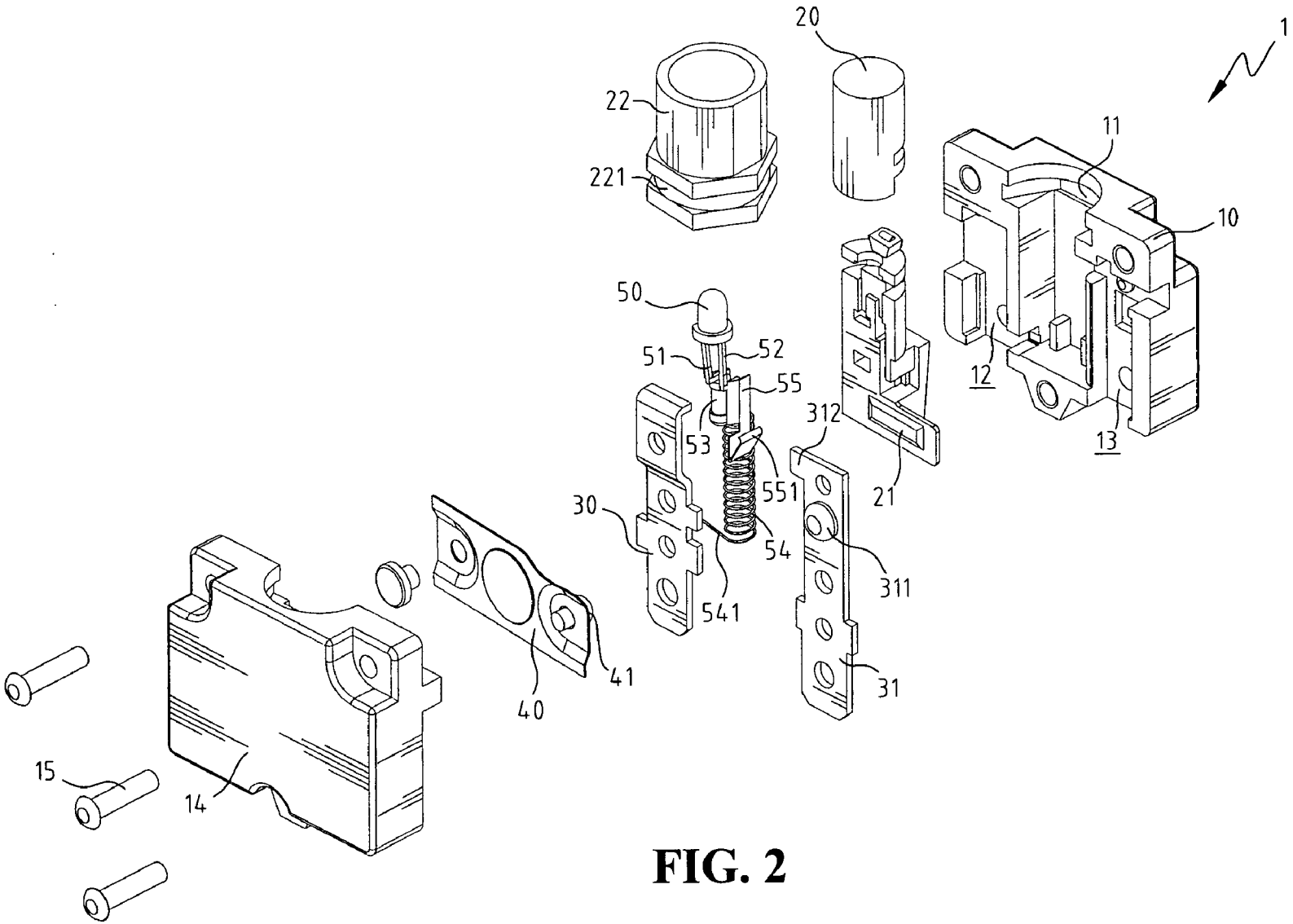
FIG. 2 is an exploded view to show the circuit protection device in accordance with the present invention.
Figure 3:
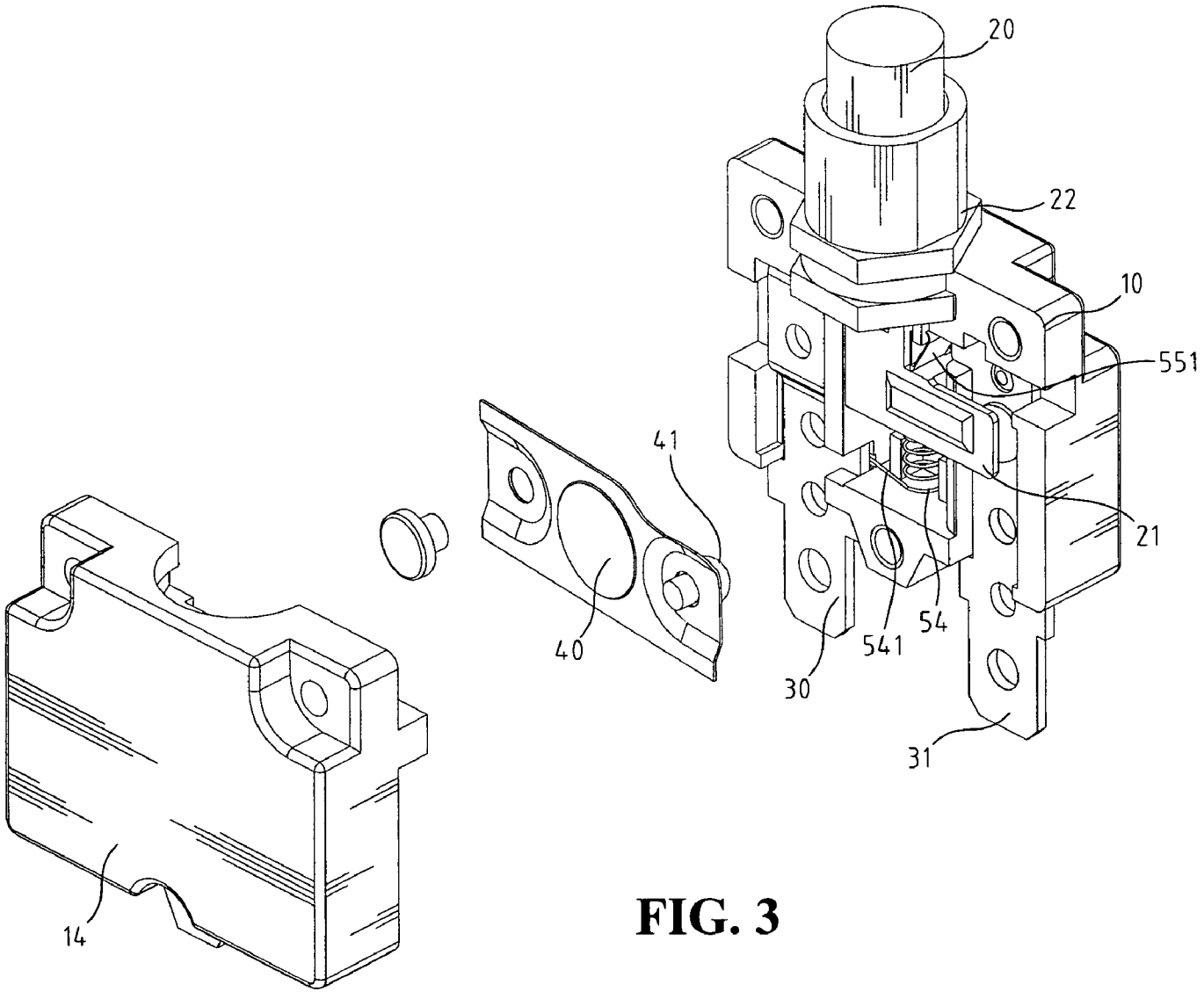
FIG. 3 is a partial exploded view to show the bimetallic plate and the circuit protection device of the present invention.

With reference to the drawings and in particular to FIGS. 1 to 3, a circuit protection device having a warning function 1 in accordance with the present invention comprises a casing 10, a button 20, at least two terminals 30, 31, a resilient bimetallic plate 40 and a warning light 50.

The casing 10 is a hollow casing so as to receive parts therein and a recess 11 is defined in the top of the casing 10 so that the button 20 is movably received in the recess 11. The casing 10 includes a first slot 12 and a second slot 13, and a cover 14 is connected to a rear opening of the casing 10 by bolts 15.

The button 20 is connected to an insulative cut-off plate 21 and received in a hollow sleeve 22 which has a neck portion 221 engaged with the recess 11 of the casing 10, so that the button 20 can be moved up and down through the sleeve 22. In this embodiment, the button 20 includes a cap and a shank, the cap and the shank are connected to each other and the cap is transparent or translucent.

The terminals include a first terminal 30 and a second terminal 31 so as to form a main circuit. The first terminal 30 extends through the first slot 12 and a lower end of the first terminal 30 extends out of the casing 10. The second terminal 31 extends through the second slot 13 and a lower end of the second terminal 31 extends out of the casing 10. The second terminal 31 includes a second contact point 311 at an upper end thereof. Moreover, the second terminal 31 includes an extension portion 312 which extends toward interior of the casing 10 and a curved angle is defined in a lower portion of the extension portion 312.

The bi-metallic plate 40 is an elastic strip and slightly curved. The bimetallic plate 40 has a first end fixed to and electrically connected with an upper end of the first terminal 30, and a second end being a free end. The free end of the bimetallic plate 40 includes a first contact point 41 corresponding to the second contact point 311. When the bimetallic plate 40 is heated, it bends to one side. When the bimetallic plate 40 is cooled, it bends to the other side.

The warning light 50 is located within the sleeve 22 of the button 20 and has a first leg 51 and a second leg 52. A resistor 53 and a resilient member 54 are connected to the first end of the first leg 51. The resilient member 54 has an extension end 541 electrically connected with the first terminal 30. One end of a connection member 55 is electrically connected with the second leg 52 and the other end of the connection member 55 is a free end 551 corresponding to the extension portion 312. In this embodiment, the connection member 55 is an elastic member and the free end 551 of the connection member 55 is a bent portion to provide a proper biasing force.

In this embodiment, the resilient member 54 is a compression spring. When it is compressed, the resilient member 54 provides an upward force to the button 20.

Figure 4A:
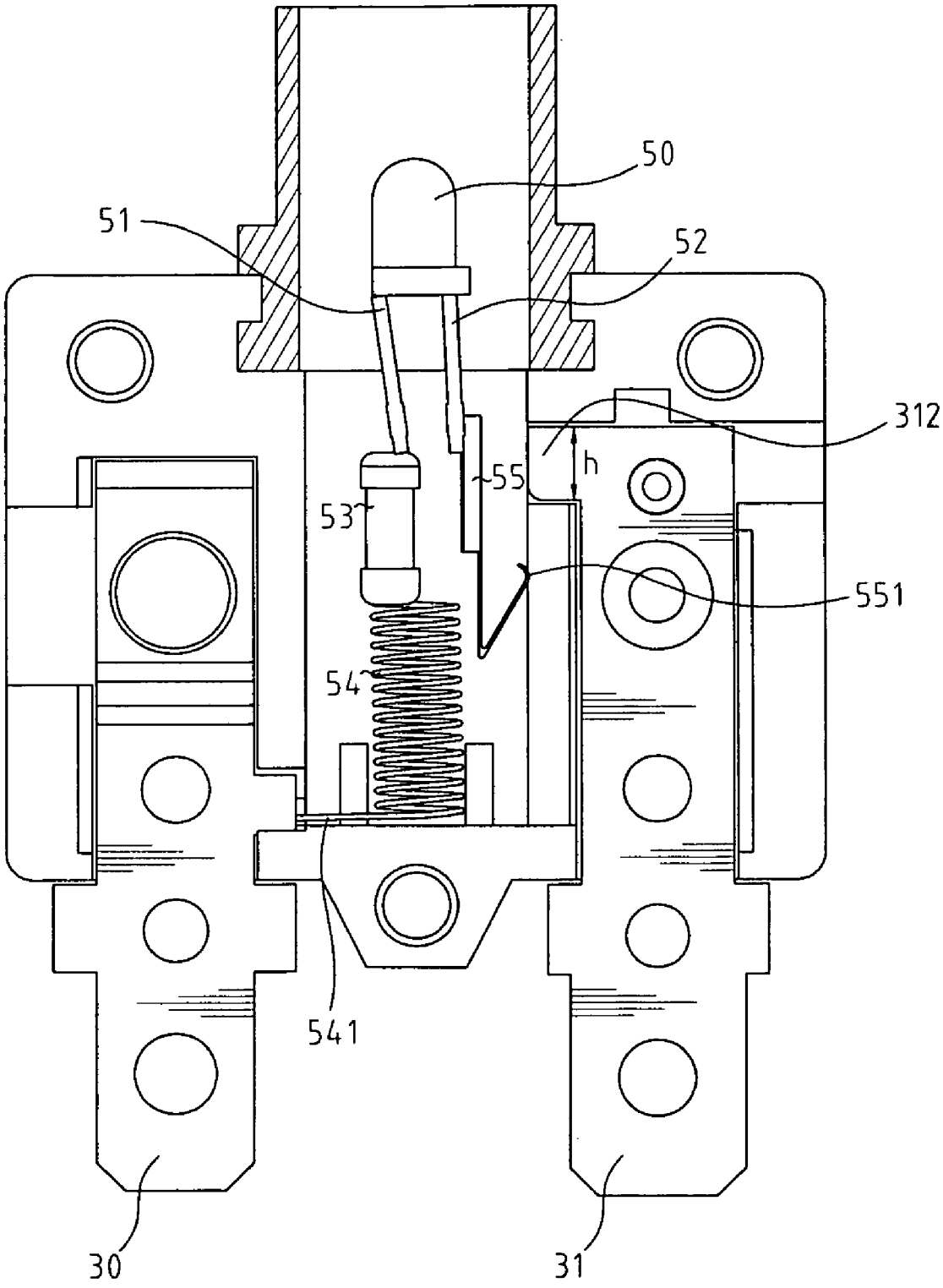
FIG. 4A shows the main circuit is connected and the button is removed for clarity purpose.
Figure 4B:
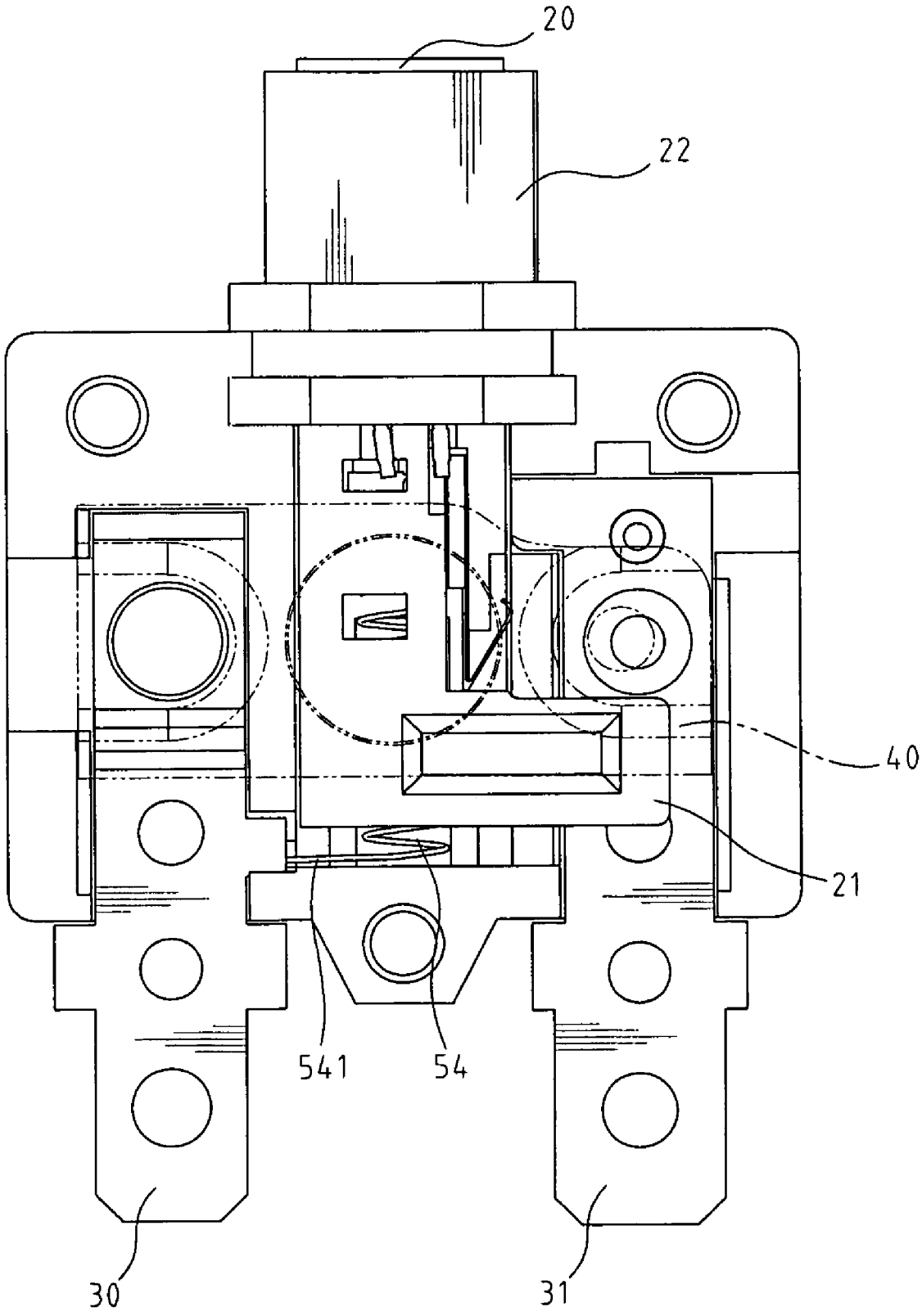
FIG. 4B shows the main circuit is connected and the bimetallic plate connects the first terminal with the second terminal.

Referring to FIGS. 4A and 4B, when the user pushes the button 20 downward, the warning light 50 moves downward and the resilient member 54 is compressed to store an upward force. The cut-off plate 21 of the button 20 moves away from a position, which is located between the first contact point 41 and the second contact point 311. The first contact point 41 is pushed by the resilient bi-metallic plate 40 to contact with the second contact point 311. The main circuit enters an "ON" state, and the current goes through the first terminal 30, the bi-metallic plate 40, the first contact point 41, the second contact point 311 and the second terminal 31. In the mean time, because the warning light 50 moves downward, the connection member 55 also moves downward. The free end 551 of the connection member 55 is separated from the extension portion 312 of the second terminal 31. The circuit for the warning light 50 is cut off so that the warning light 50 is not activated.

Figure 5A:
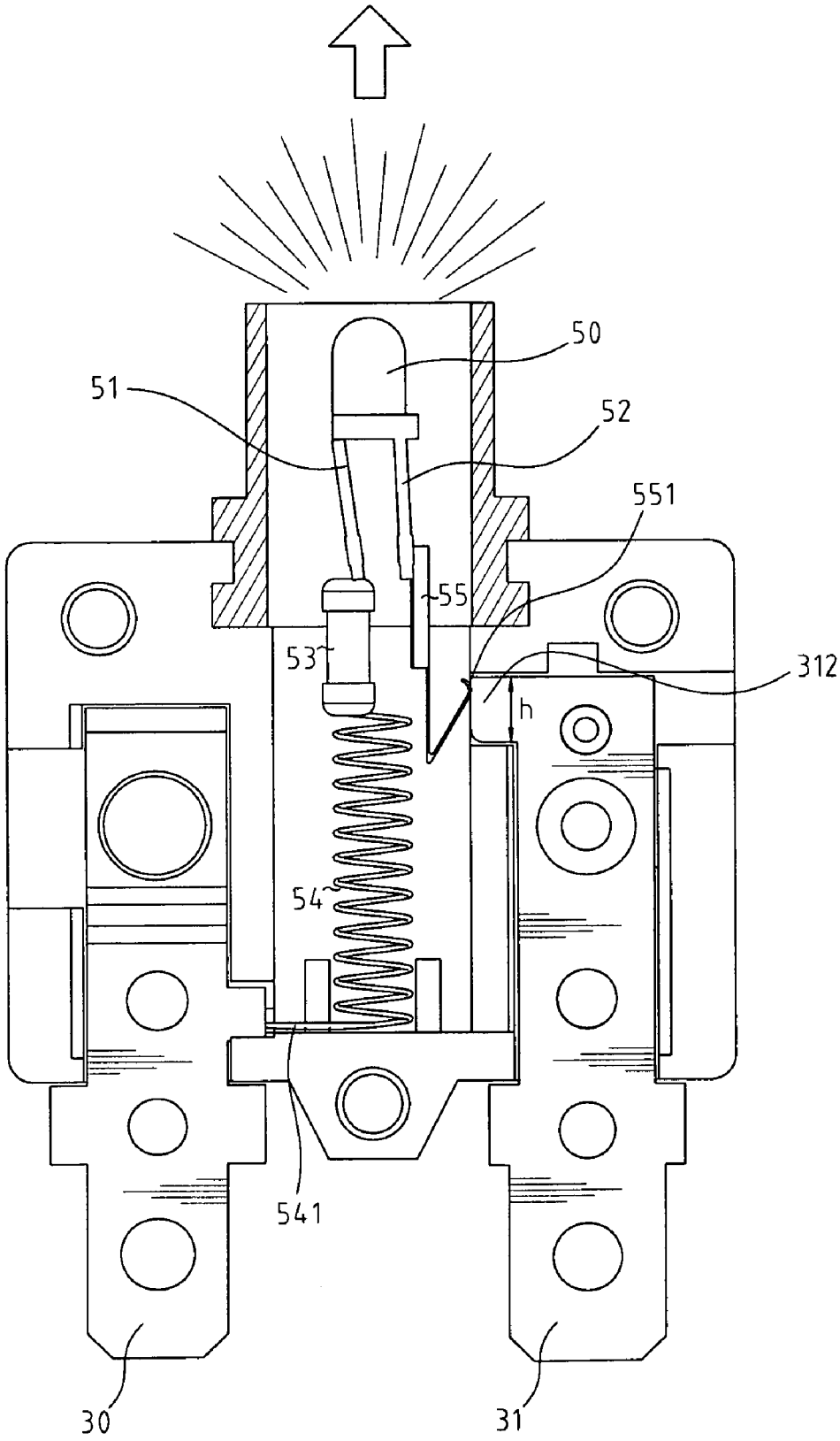
FIG. 5A shows the main circuit is cut off and the button is removed for clarity purpose.
Figure 5B:
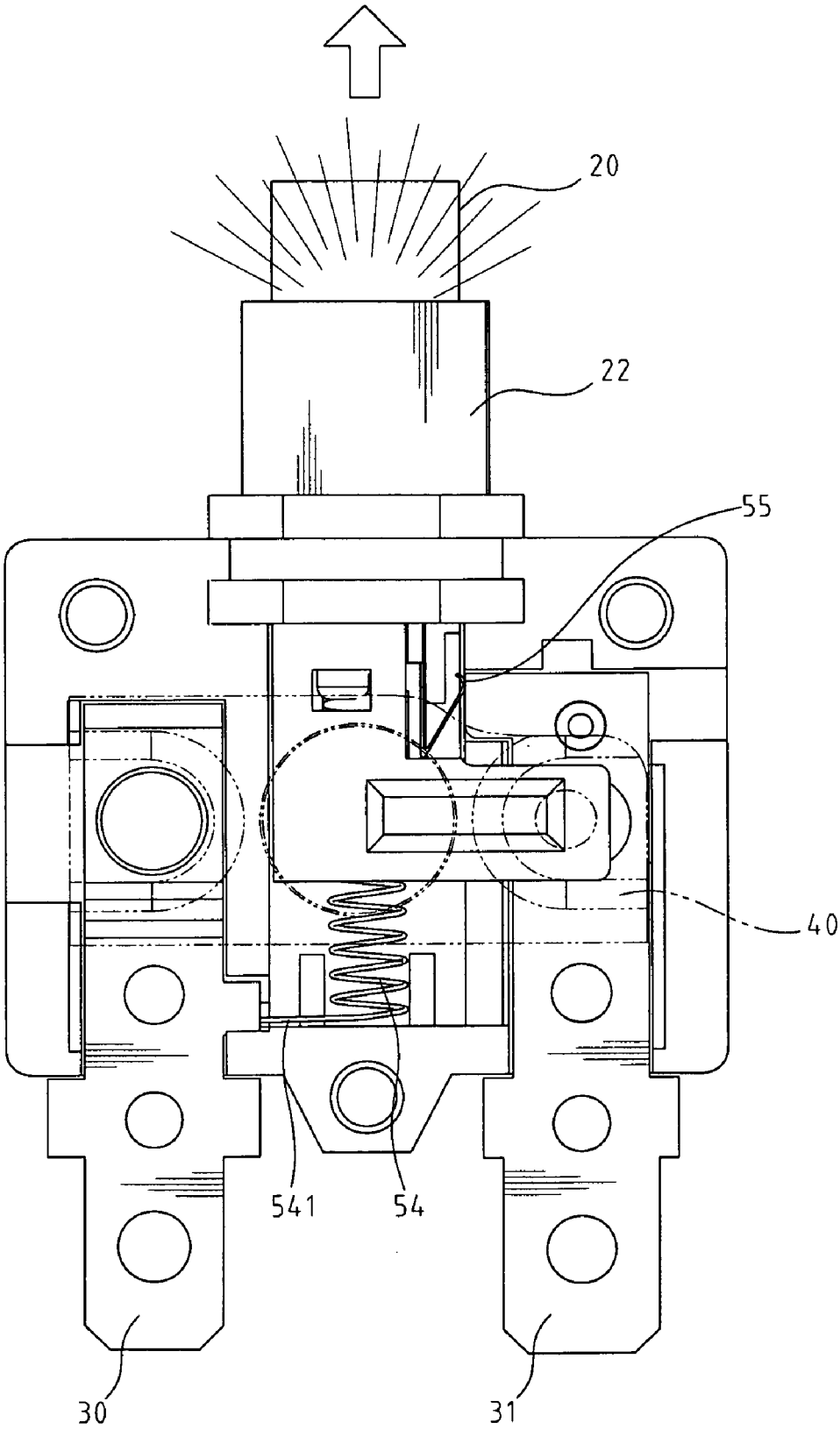
FIG. 5B shows the main circuit is cut off and the warning light lights up.

Referring to FIGS. 5A and 5B, when the main circuit is overheated, the bi-metallic plate 40 bends to separate the first contact point 41 of the bi-metallic plate 40 from the second contact point 311 of the second terminal 31. The button 20 is pushed upward by the resilient member 54 and the warning light 50 is moved upward with the button 20. Further, the cut-off plate 21 is moved upward to the position between the first and the second contact points 41, 311. Thus, the main circuit is cut off and enters an "OFF" state. In the meanwhile, the warning light 50 moves upward and the free end 551 of the connection member 55 is in contact with the extension portion 312 of the second terminal 31. A circuit of the warning light 50 is formed and the current flows through the first terminal 30, the extension end 541 of the resilient member 54, the resilient member 54, the resistor 53, the first leg 51, the warning light 50, the second leg 52, the connection member 55, the free end 551 of the connection member 55, the extension portion 312 of the second terminal 31 and the second terminal 31. The warning light 50 lights up and the light beam from the warning light 50 can be seen through the button 20.

Figure 6:
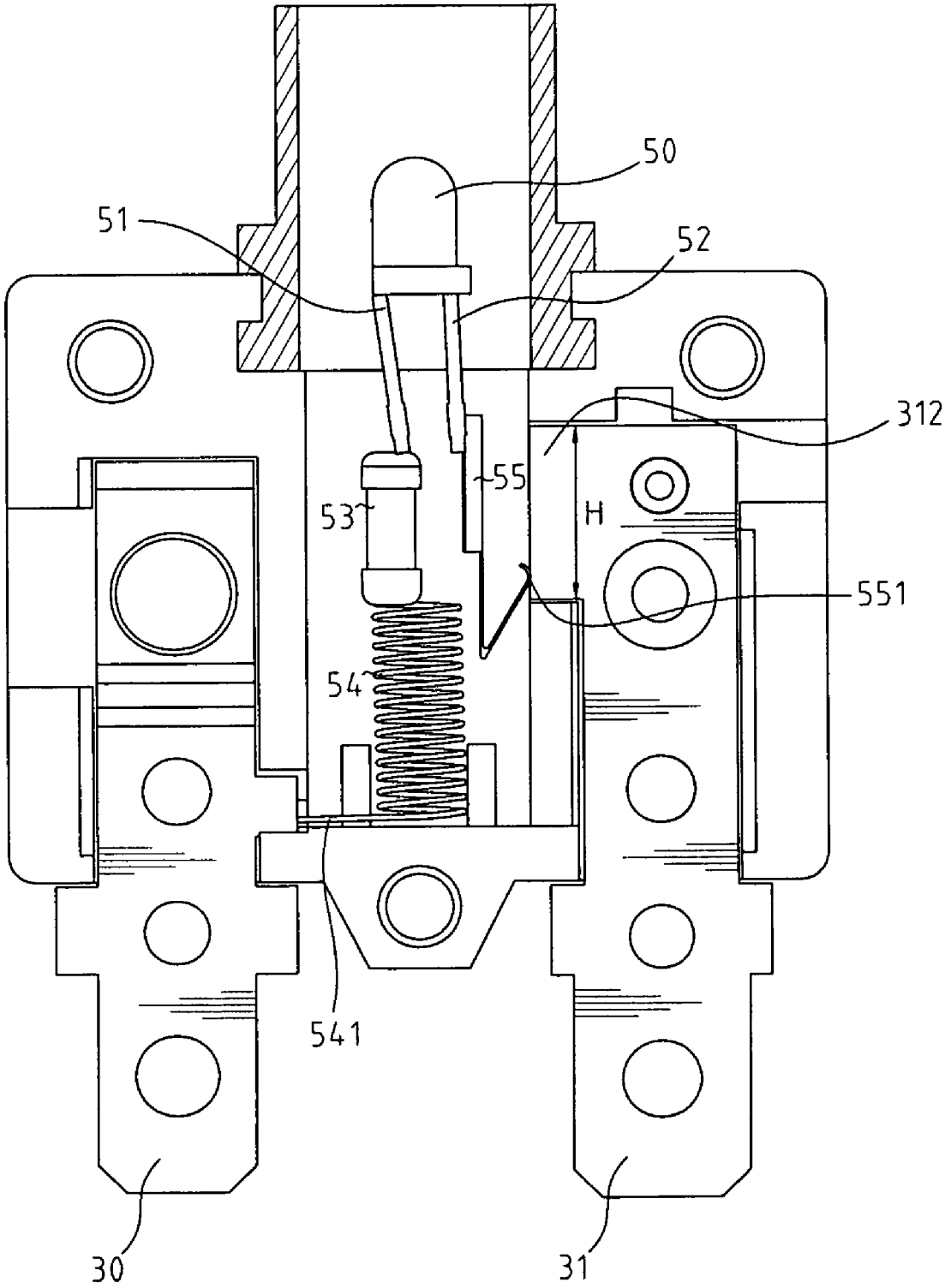
FIG. 6 shows a second embodiment of the circuit protection device having the warning function wherein the main circuit is connected, and the button is removed for clarity purpose.
Figure 7:
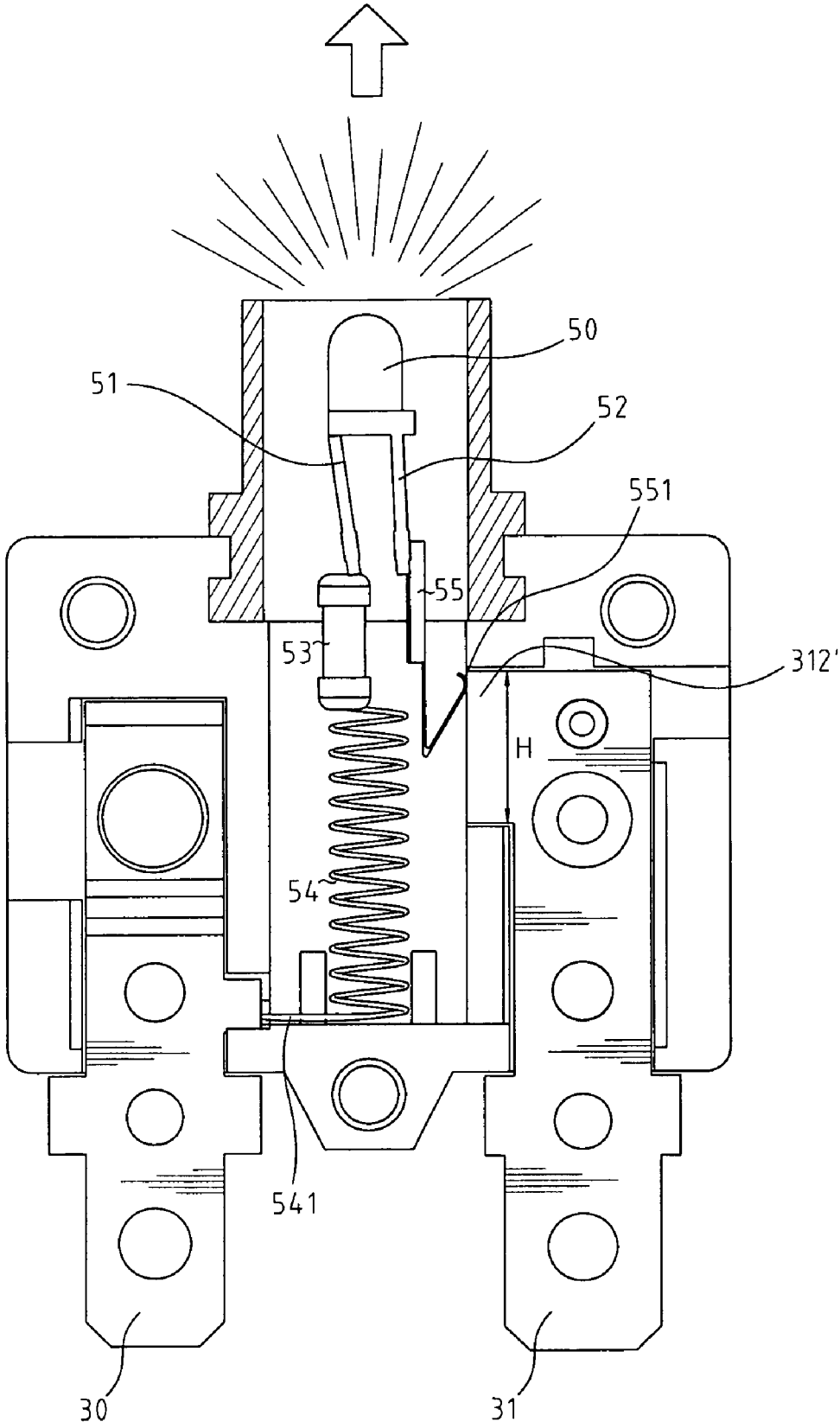
FIG. 7 shows the second embodiment of the circuit protection device wherein the main circuit is cut off, and the warning light lights up.

FIGS. 6 and 7 show a circuit protection device having a warning function according to a second embodiment of the present invention. FIG. 6 shows that the main circuit is connected by the circuit protection device with the button being omitted for clarity. FIG. 7 shows that the main circuit is cut off and the warning light lights up.

The second embodiment of the circuit protection device is almost the same as the first embodiment as disclosed in FIGS. 1-3, wherein the difference is that the length "H" of the extension portion 312' of the second terminal 31 is longer than the length "h" of the extension portion 312 of the second terminal 31. Besides, the length "H" of the extension portion 312' of the second terminal 31 is longer than the traveling distance of the connection member 55. By the specific arrangement, the free end 551 of the connection member 55 according to the second embodiment is kept in touch with the extension portion 312' of the second terminal 31 all the time as shown in FIGS. 6 and 7.

As shown in FIG. 6, when the main circuit is connected, further referring to FIGS. 4A and 4B, the main circuit is formed and enters an "ON" state. The electric current goes through the first terminal 30, the bi-metallic plate 40, the first contact point 41, the second contact point 311 and the second terminal 31. Although the warning light 50 is moved downward, the free end 551 of the connection member 55 is still in contact with the lower portion of the extension portion 312' of the second terminal 31 and the circuit for the warning light 50 is connected. However, almost all of the current goes through the main circuit and the current going through the circuit for the warning light 50 approaches zero. Thus, the warning light 50 is not activated.

As shown in FIG. 7, when the main circuit is overheated, the main circuit is cut off as shown in FIGS. 5A and 5B. The warning light 50 is moved upward, the free end 551 of the connection member 55 is still in contact with the upper portion of the extension portion 312' of the second terminal 31. A circuit is formed for the warning light 50 and the current flows through the first terminal 30, the extension end 541, the resilient member 54, the resistor 53, the first leg 51, the warning light 50, the second leg 52, the connection member 55, the free end 551 of the connection member 55, the extension portion 312 and the second terminal 31. The warning light 50 is activated and can be seen through the button 20.

Figure 8:
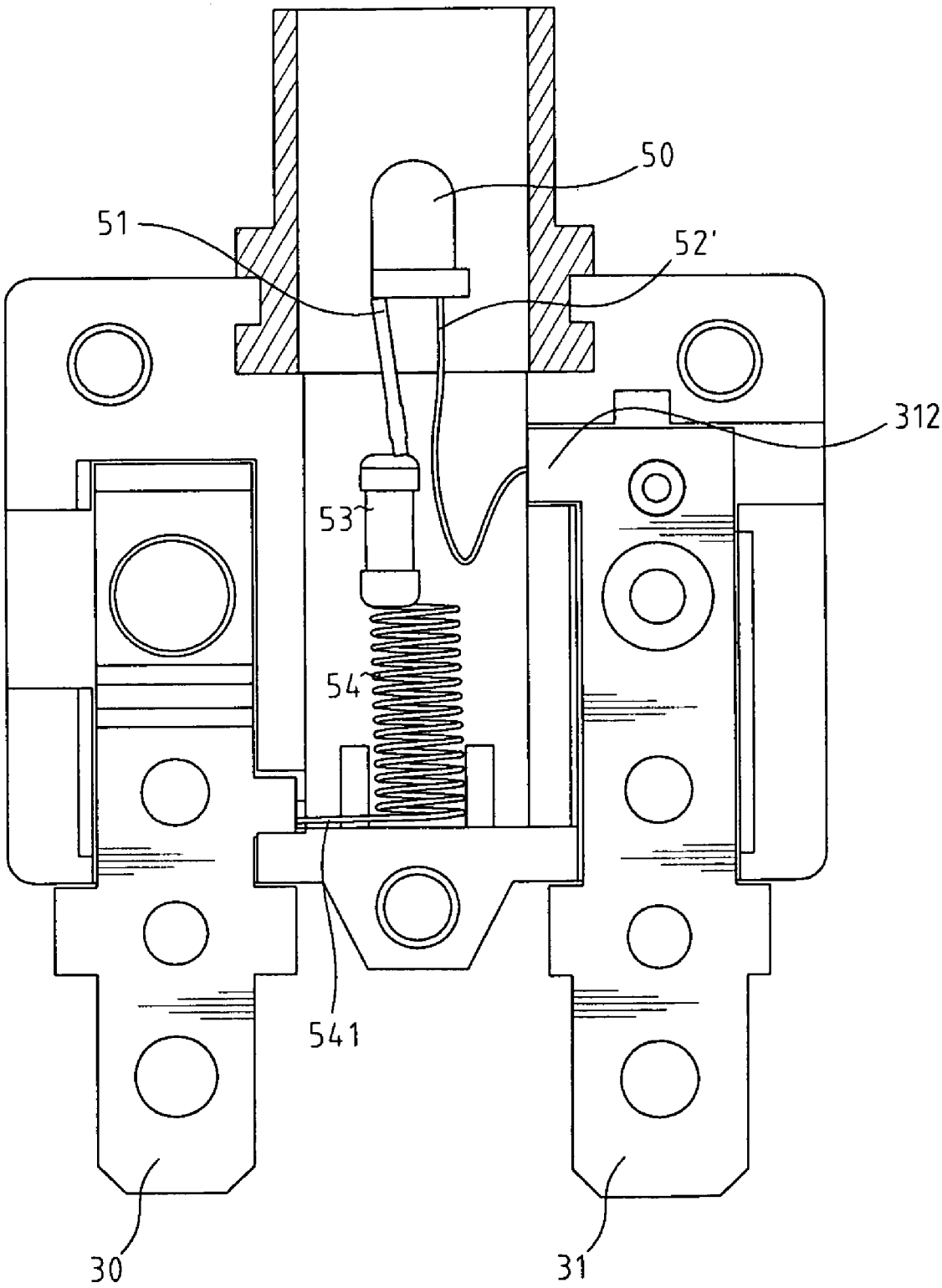
FIG. 8 shows a third embodiment of the circuit protection device having the warning function wherein the main circuit is connected, and the button is removed for clarity purpose.
Figure 9:
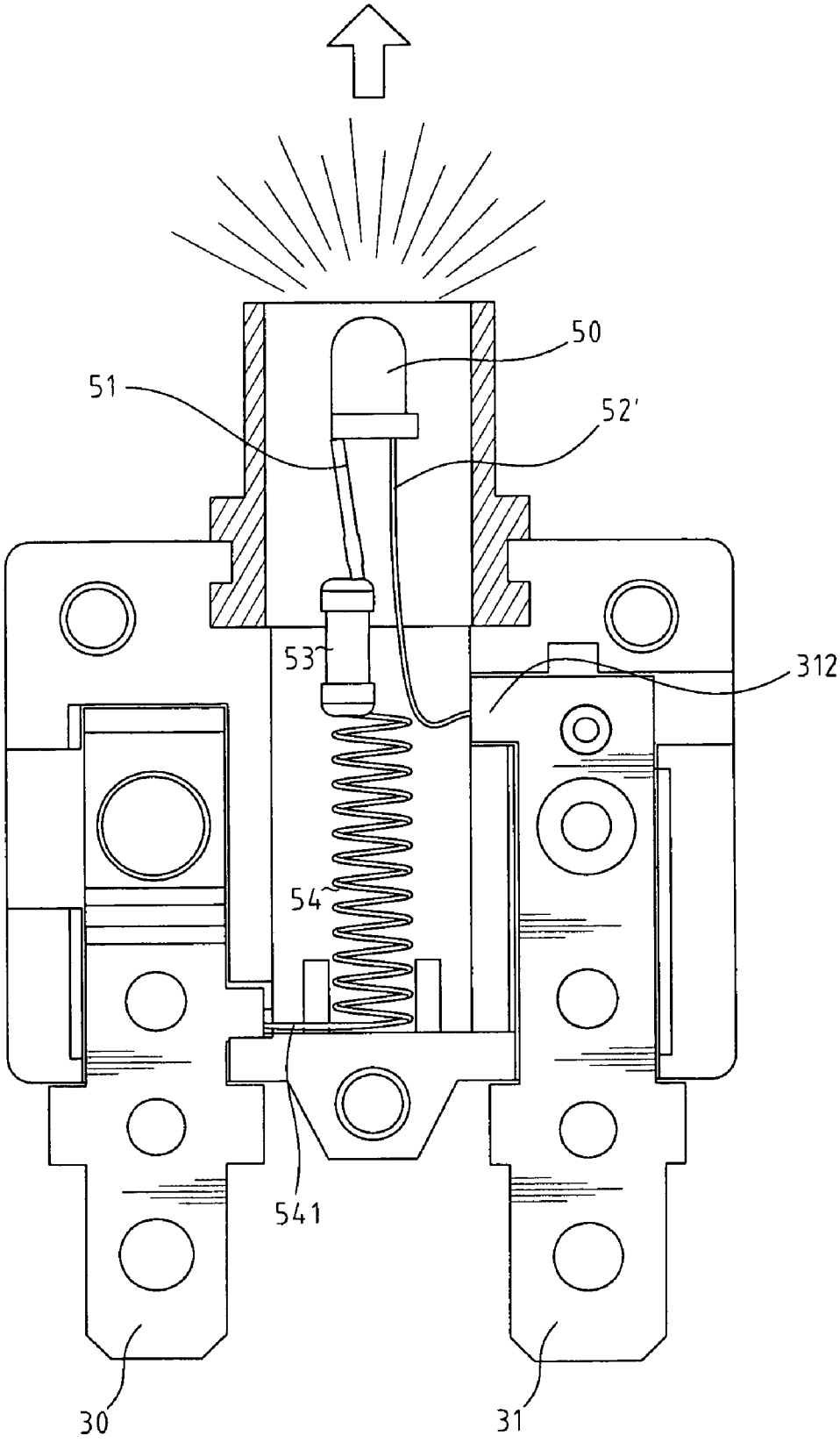
FIG. 9 shows the third embodiment of the circuit protection device wherein the main circuit is cut off, and the warning light lights up.

FIGS. 8 and 9 show a circuit protection device having a warning function according to a third embodiment. FIG. 8 shows that the main circuit is connected by the circuit protection device with the button being omitted. FIG. 9 shows that the main circuit is cut off and the warning light 50 lights up.

The third embodiment of the circuit protection device is almost the same as the first embodiment as disclosed in FIGS. 1-3, wherein the difference is that the second leg 52' of the warning light 50 is connected to the second terminal 31. In the third embodiment, the second leg 52' is a soft conductive wire which can be easily bent and a distal end of the second leg 52' is soldered to the extension portion 312 of the second terminal 31.

The principle of the third embodiment is the same as the second embodiment. In operation, the second leg 52' of the warning light 50 is always in contact with the second terminal 31 whenever the main circuit is connected to be in an "ON state or is disconnected to be in an "OFF" state. The circuit for the warning light 50 is always connected.

As shown in FIG. 8, the main circuit is connected. Almost all of the current goes through the main circuit and the current going through the circuit of the warning light 50 approaches nil. Therefore, the warning light 50 does not light up.

As shown in FIG. 9, when the main circuit is overheated, the main circuit is cut off and the warning light 50 moves upward. Although the second leg 52' is moved upward with the warning light 50, the second leg 52' is still connected to the extension portion 312 of the second terminal 31. A circuit is formed for the warning light 50 via the first terminal 30, the extension end 541, the resilient member 54, the resistor 53, the first leg 51, the warning light 50, the second leg 52', the extension portion 312 and the second terminal 31. The warning light 50 is activated by the current flowing through the circuit to inform the users that the main circuit is cut off.

Figure 10:
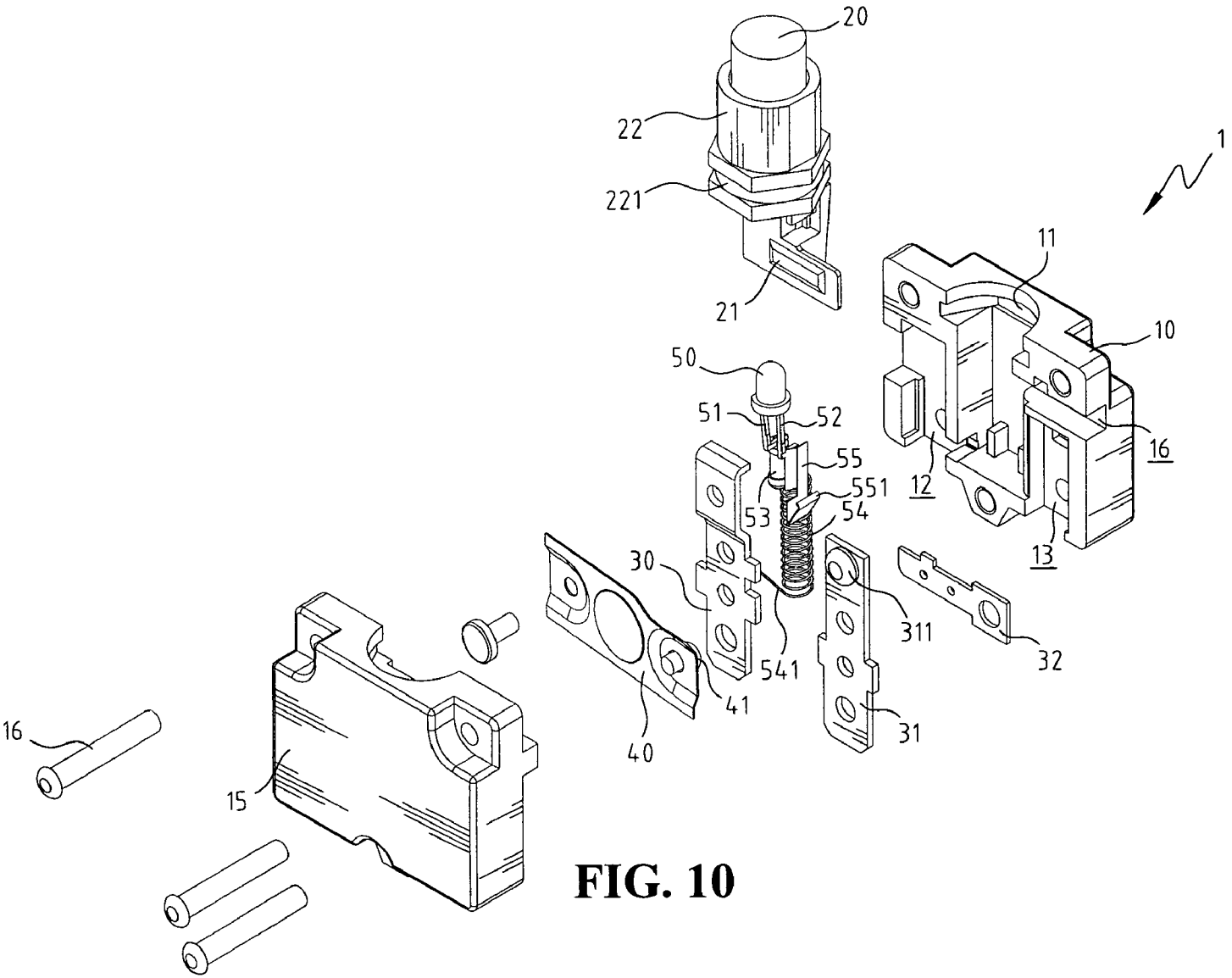
FIG. 10 is an exploded view to show a fourth embodiment of the circuit protection device having the warning function of the present invention.

FIG. 10 shows a circuit protection device having a warning function according to a fourth embodiment of the present invention. The differences between the fourth embodiment and the first embodiment include: the casing 10 further includes a third slot 16; the terminals further includes a third terminal 32; and the extension portion 312 of the second terminal 31 is removed. The third terminal 32 does not contact with the second terminal 31. The third terminal 32 extends through the third slot 16 and an exterior end of the third terminal 32 extends out of the case 10.

Figure 11:
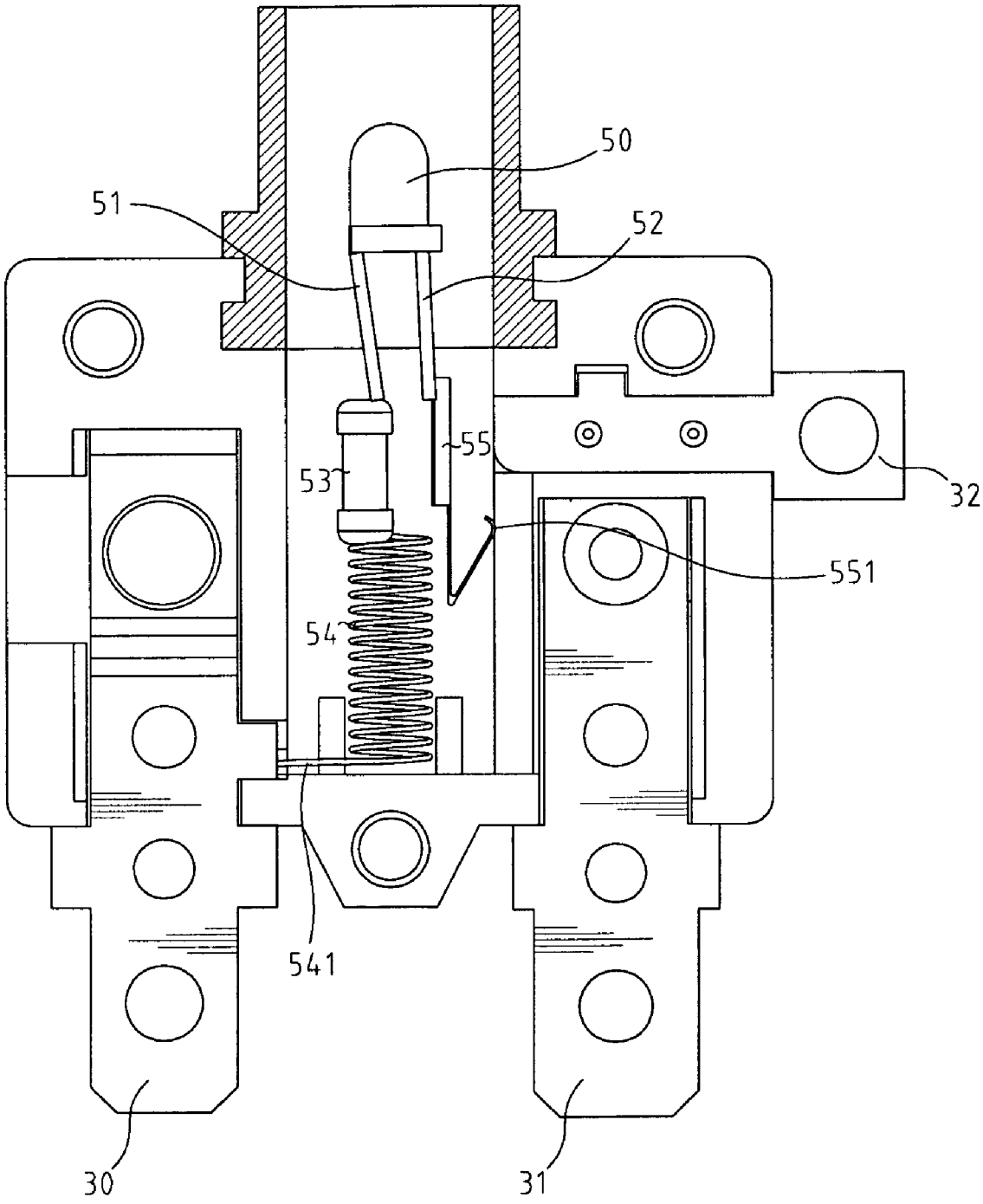
FIG. 11 shows the fourth embodiment of the circuit protection device wherein the main circuit is connected, and the button is removed for clarity purpose.

As shown in FIG. 11, the operation of the fourth embodiment of the present invention is the same as the previous embodiments. Further referring to FIGS. 4A and 4B, when the main circuit is connected, the circuit for the warning light 50 is cut off and the warning light 50 is not activated.

Figure 12:
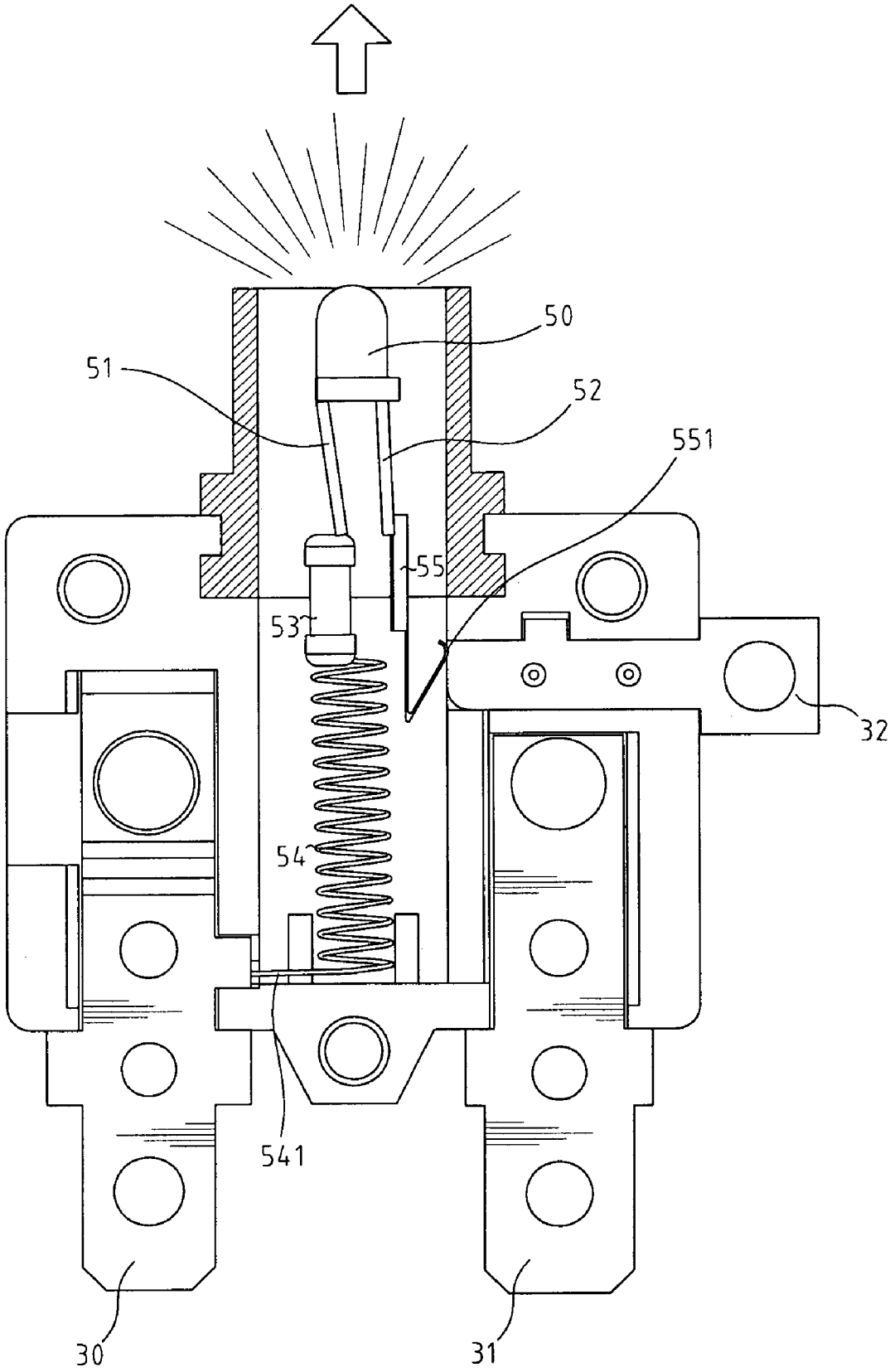
FIG. 12 shows the fourth embodiment of the circuit protection device wherein the main circuit is cut off, and the warning light lights up.

As shown in FIG. 12, when the main circuit is overheated, and the main circuit is cut off, the warning light 50 moves upward. The free end 551 of the connection member 55 on the second leg 52 is in contact with the third terminal 32. A circuit is formed via the first terminal 30, the extension end 541, the resilient member 54, the resistor 53, the first leg 51, the warning light 50, the second leg 52, the connection member 55, the free end 551 and the third terminal 32. The warning light 50 is activated by the current flowing through the circuit to inform the users that the main circuit is cut off.

In the fourth embodiment, the circuit for the warning light 50 is formed via the first terminal 30 and the third terminal 32. The circuit for the warning light 50 is different from that of the previous embodiments whose circuit for the warning light 50 is connected via the first terminal 30 to the second terminal 31. In the fourth embodiment, the main circuit and the circuit for the warning light 50 are two separated circuits. The fourth embodiment ensures safe use of the electric appliances and is especially suitable for those appliances using less current.

In the previous embodiments of the circuit protection device of the present invention, when the main circuit is connected, the warning light 50 is not activated. When the main circuit is overheated, the bi-metallic plate 40 bends to cut off the main circuit to ensure safety. In the meanwhile, a circuit is formed to activate the warning light 50 to inform the users that the main circuit is abnormal.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A circuit protection device having a warning function, comprising:

a casing;

a button connected to the casing and capable of moving up and down;

a first terminal and a second terminal connected to the casing;

a resilient bi-metallic plate capable of bending toward two opposite directions due to temperature change; and a warning light located within the button and having a first leg and a second leg, a resistor and a resilient member connected to the first leg, a connection member electrically connected to the second leg, the resilient member electrically connected with the first terminal, the resilient member capable of providing an upward elastic force to the button and the warning light;

wherein when the button and the warning light are moved downward, the resilient member is compressed, the bi-metallic plate electrically connects the first terminal with the second terminal, a main circuit is connected with the first terminal, the bi-metallic plate and the second terminal, and the connection member of the warning light is separated from the second terminal to disconnect a circuit of the warning light; and wherein when the main circuit is overheated, the bi-metallic plate bends to separate from the second terminal, the main circuit is cut off, and the button and the warning light are pushed upward by the resilient member so that the connection member is in contact with the second terminal to form the circuit of the warning light via the first terminal, the resilient member, the resistor, the warning light, the connection member and the second terminal, and the warning light lights up.

2. The circuit protection device as claimed in claim 1, wherein the casing includes a first slot and a second slot, and the first terminal extends through the first slot and the second terminal extends through the second slot;

the bi-metallic plate has a first end fixed to the first terminal and a second end being a free end, the free end of the bi-metallic plate has a first contact point, and the second terminal includes a second contact point which is located corresponding to the first contact point;

the button is connected to a cut-off plate which is capable of moving to or away from a position between the first contact point and the second contact point; and one end of the connection member is connected with the second leg and the other end of the connection member is a free end;

wherein when the main circuit is connected, the button is pushed downward and the cut-off plate moves away from the position between the first contact point and the second contact point, the first contact point is pressed to contact with the second contact point, the main circuit is formed via the first terminal, the bi-metallic plate, the first contact point, the second contact point and the second terminal, the free end of the connection member is separated from the second terminal and the warning light is not activated; and wherein when the main circuit is overheated, the bi-metallic plate bends to separate the first contact point from the second contact point, the cut-off plate is moved upward and located between the first contact point and the second contact point to cut off the main circuit, the free end of the connection member on the warning light is in contact with the second terminal, the circuit of the warning light is formed via the first terminal, the resilient member, the resistor, the first leg, the warning light, the second leg, the connection member and the second terminal, and the warning light lights up.

3. The circuit protection device as claimed in claim 1, wherein a recess is defined in the casing, a sleeve is engaged with the recess in the casing, and the button is located in the sleeve and is up-and-down movable within the sleeve.

4. The circuit protection device as claimed in claim 1, wherein an extension portion is formed on the second terminal and extends toward interior of the casing, the connection member of the warning light is separated from the extension portion when the main circuit is connected, and when the main circuit is cut off due to overheat, the connection member is in contact with the extension portion of the second terminal.

5. The circuit protection device as claimed in claim 2, wherein the free end of the connection member on the warning light is a bent portion.

6. The circuit protection device as claimed in claim 1, wherein the resilient member is a compression spring.

7. The circuit protection device as claimed in claim 2, wherein the casing includes a third slot and a third terminal extends through the third slot, the third terminal is separated from the second terminal, and when the main circuit is cut off due to overheat, the connection member of the warning light is in contact with the third terminal, the circuit of the warning light is formed via the first terminal, the resilient member, the resistor, the warning light, the connection member and the third terminal, and the warning light lights up.

8. A circuit protection device having a warning function, comprising:

a casing;

a button connected to the casing and capable of moving up and down;

a first terminal and a second terminal connected to the casing;

a resilient bi-metallic plate capable of bending toward two opposite directions due to temperature change; and a warning light located within the button and having a first leg and a second leg, a resistor and a resilient member connected to the first leg, a connection member electrically connected to the second leg, the resilient member electrically connected with the first terminal, the resilient member capable of providing an upward elastic force to the button and the warning light;

wherein when the button and the warning light are moved downward, the resilient member is compressed, the bi-metallic plate electrically connects the first terminal with the second terminal, a main circuit is connected with the first terminal, the bi-metallic plate and the second terminal, and the connection member of the warning light is in contact with the second terminal and therefore a circuit of the warning light is connected but not activated because all current flows through the main circuit and the current flowing through the circuit of the warning light approaches zero; and wherein when the main circuit is overheated, the bi-metallic plate bends to separate from the second terminal, the main circuit is cut off, and the button and the warning light are pushed upward by the resilient member so that the connection member is still in contact with the second terminal to form the circuit of the warning light via the first terminal, the resilient member, the resistor, the warning light, the connection member and the second terminal, and the warning light lights up.

9. The circuit protection device as claimed in claim 8, wherein the casing includes a first slot and a second slot, and the first terminal extends through the first slot and the second terminal extends through the second slot;

the bi-metallic plate has a first end fixed to the first terminal and a second end being a free end, the free end of the bi-metallic plate has a first contact point, and the second terminal includes a second contact point which is located corresponding to the first contact point;

the button is connected to a cut-off plate which is capable of moving to or away from a position between the first contact point and the second contact point; and one end of the connection member is connected with the second leg and the other end of the connection member is a free end.

10. The circuit protection device as claimed in claim 8, wherein an extension portion is formed on the second terminal and extends toward interior of the casing, a length of the extension portion is longer than a traveling distance of the connection member of the warning light, thereby keeping the connection member in contact with the extension portion.

11. The circuit protection device as claimed in claim 8, wherein the resilient member is a compression spring.

12. The circuit protection device as claimed in claim 8, wherein the connection member of the warning light is a soft conductive wire which is electrically connected with the second terminal.

13. The circuit protection device as claimed in claim 9, wherein the second leg and the connection member of the warning light are formed by a soft conductive wire which is electrically connected with the second terminal.

14. The circuit protection device as claimed in claim 9, wherein the second leg of the warning light is a soft conductive wire which is in contact with the second terminal.

* * * * *